US009624068B1

(12) United States Patent
Knierim

(10) Patent No.: US 9,624,068 B1
(45) **Date of Patent: *Apr. 18, 2017**

(54) LINEAR MEDIA HANDLING SYSTEM

(71) Applicant: Infinity Physics, LLC, Littleton, CO (US)

(72) Inventor: Glenn Auld Knierim, Littleton, CO (US)

(73) Assignee: Infinity Physics, LLC, Littleton, CO (US)

( * ) Notice: Subject to any disclaimer, the term of this patent is extended or adjusted under 35 U.S.C. 154(b) by 187 days.

This patent is subject to a terminal disclaimer.

(21) Appl. No.: 14/569,314

(22) Filed: Dec. 12, 2014

Related U.S. Application Data

(63) Continuation of application No. 13/269,549, filed on Oct. 7, 2011, now Pat. No. 8,936,209, which is a continuation-in-part of application No. 13/114,012, filed on May 23, 2011, now abandoned.

(60) Provisional application No. 61/347,374, filed on May 21, 2010.

(51) Int. Cl.
*B65H 59/38* (2006.01)

(52) U.S. Cl.
CPC ..... *B65H 59/38* (2013.01); *B65H 2701/32* (2013.01); *B65H 2701/36* (2013.01)

(58) Field of Classification Search
CPC B65H 59/385; B65H 59/387; B65H 2701/32; B65H 2701/34; B65H 2701/341; B65H 2701/36
USPC ..... 242/412, 412.1, 413, 413.3–413.6, 242/414–414.1, 420, 155 R, 155 M, 242/155 BW, 478.2, 484–484.1
See application file for complete search history.

(56) References Cited

U.S. PATENT DOCUMENTS

| | | | | |
|---|---|---|---|---|
| 4,347,993 | A | 9/1982 | Leonard | |
| 4,407,062 | A | 10/1983 | Sutcliffe et al. | |
| 4,434,945 | A | 3/1984 | Hamane et al. | |
| 4,546,656 | A | 10/1985 | Grundy et al. | |
| 4,548,085 | A | 10/1985 | Grundy | |
| 4,773,607 | A * | 9/1988 | Missout | G02B 6/449 19/159 R |
| 5,421,534 | A | 6/1995 | Arnold et al. | |
| 5,551,144 | A | 9/1996 | Mantone et al. | |
| 5,681,006 | A | 10/1997 | Herd et al. | |
| 6,387,852 | B1 | 5/2002 | Celik et al. | |
| 6,395,080 | B1 | 5/2002 | Cass et al. | |
| 6,510,604 | B1 | 1/2003 | Pourrahimi | |
| 6,584,334 | B2 | 6/2003 | Pereira et al. | |

(Continued)

FOREIGN PATENT DOCUMENTS

| | | | |
|---|---|---|---|
| GB | 2043715 | A | 10/1980 |
| JP | 06005416 | A * | 1/1994 |

*Primary Examiner* — William E Dondero
(74) *Attorney, Agent, or Firm* — Sheridan Ross P.C.

(57) ABSTRACT

An improved system for handling delicate linear media and in particular to a method and apparatus for winding delicate linear media such as superconducting wire or optical fibers onto a spool. A combination of direct closed loop control and media routing design facilitates the handling of the delicate media without causing damage. The axial tension in the linear media may be closely controlled during winding by means of feedback control loop using tension measurements to control the rotation speeds of the wind-from and wind-to spools. Further, during winding, the delicate linear media is only exposed to large radius bends with no reverse bending.

22 Claims, 9 Drawing Sheets

(56) References Cited

U.S. PATENT DOCUMENTS

| | | | |
|---|---|---|---|
| 6,603,379 | B1 | 8/2003 | Manlief et al. |
| 6,820,833 | B1 | 11/2004 | Carlsson et al. |
| 6,991,144 | B2 | 1/2006 | Franz et al. |
| 8,936,209 | B1 | 1/2015 | Knierim |
| 2002/0183208 | A1 | 12/2002 | Pereira et al. |
| 2004/0094656 | A1 | 5/2004 | Perry et al. |
| 2004/0206849 | A1 | 10/2004 | Harrington |
| 2004/0211851 | A1 | 10/2004 | Barton et al. |
| 2004/0245365 | A1 | 12/2004 | Ramesh |
| 2009/0183486 | A1 | 7/2009 | Beck et al. |

* cited by examiner

LINEAR MEDIA HANDLING SYSTEM

CROSS-REFERENCE TO RELATED APPLICATION

This application is a Continuation of U.S. patent application Ser. No. 13/269,549, entitled "Linear Media Handling System," filed on Oct. 7, 2011, which is a Continuation-In-Part of U.S. patent application Ser. No. 13/114,012, entitled "Linear Media Handling System," filed on May 23, 2011, which claims the benefit of U.S. Provisional Application Ser. No. 61/347,374, entitled "Linear Media Handling System," filed on May 21, 2010, the entireties of these applications are incorporated by reference herein.

TECHNICAL FIELD OF THE INVENTION

The present invention relates to handling and manipulation of delicate linear media, and in particular to a method and apparatus for winding delicate linear media such as superconducting wire or optical fibers onto a spool.

BACKGROUND OF THE INVENTION

Winding machines have a long history. Such machines are used in various applications to wind linear media, such as wire or cable, onto a spool to form a coil. In some embodiments, conductive coils can be formed by winding an electrical conductor around a coil form such as a spool or a core. An example of a conductive coil can be seen in a rotor of an electric motor, where the rotor includes an insulated resistive conductor (such as a copper wire surrounded by electrical insulation) wound around an iron core. Winding machines are also commonly used to wind coils of wire or other material onto large spools for storage or transport.

While prior art winding machines work reasonably well for materials such as metal wire, there are a number of delicate linear media types today that are too fragile for prior art winding machines and techniques. Examples of such delicate media include low and high temperature superconducting wire, very fine conventional wire, fiber optic wire, thin strands of carbon based fiber, smart fabrics, or extremely dense fine fiber matrices for impact or extreme environment protection. While the method and apparatus of the present invention could be applicable to any of these delicate media types, much of the present discussion will focus on superconductor wire, particularly brittle superconductor types such as reacted magnesium diboride ($MgB_2$) or niobium-3 tin ($Nb_3Sn$) wire.

A superconductor is a material that exhibits extremely low electrical resistance at low temperatures. Superconducting cables and wires are used in a variety of applications, including the production of powerful electromagnets used in magnetic resonance imaging (MRI), nuclear magnetic resonance (NMR) spectroscopy, mass spectrometers, and beam steering magnets for particle accelerators. Superconducting magnetic coils, like most magnetic coils, are formed by wrapping an insulated conducting material around a form defining the shape of the coil. When the temperature of the coil is sufficiently low that the conductor can exist in a superconducting state, the current-carrying performance of the conductor is greatly increased and large magnetic fields can be generated by the coil.

To wind a cable or wire into a coil, the cable or wire must be bent. The smaller the coil, the more the cable, or wire must be bent. When a superconductor or superconducting cable is bent, strain is induced on the superconducting filaments. Since many superconductors are brittle, bending them can cause them to break. When superconductor wires are wound onto a spool, for example by a prior art winding machine, the stress on the superconducting filaments can be great enough that the superconducting properties of the wires can be destroyed. As a result, for a given superconductor or superconducting cable, there is a lower limit on the radius of curvature to which the superconductor or superconducting cable can be wound within the magnet system, dependent on the irreversible strain of the superconducting filaments within the superconductor or superconducting cable.

Because of the difficulties in handling certain particularly brittle low-temperature superconducting cables/wires, a "wind-then-react" method is often used, whereby the unreacted precursor to a superconductor is wound in a coil around a form or spool and then the entire spool is processed with high temperatures and an oxidizing environment. This results in the conversion of the precursor material into the desired superconductor material already formed into the desired coil shape.

However, this approach has several disadvantages in many cases. Because the precursor material must be heated after the wire is coiled onto a magnet system and spool, all of the components of the magnet system must be able to withstand with the high temperatures used during the formation of the superconducting phase. This means, for example, that the magnet system cannot include aluminum or its alloys since these melt at the temperatures used during formation of the superconducting filaments. It is also difficult and expensive to apply insulation to a wound coil in order to prevent electrical current flow between the turns. Finally, the "wind-then-react" method also leads to storage difficulties and added expense because the superconducting wire cannot be easily prepared and stored ahead of time (since it must be formed onto the spool or system in which it will be used).

One particular problem area is seen in the production of MRI machines, large motors or generators, or large accelerator magnets, which all require a coil of superconducting wire that is several kilometers in length and weighs hundreds to thousands of pounds. The sheer size of the required coil presents a number of difficulties when using a "wind-then-react" method since the entire coil must be placed in an oven for processing.

In contrast, a "react-then-wind" method of production would provide a number of advantages, including decreased manufacture and storage costs and allowing for a broader range of materials to be used with the magnet system. But despite these known advantages, the difficulties in handling reacted superconductor wires without damage—especially for lower cost superconducting materials like magnesium diboride—has prevented the "react-then-wind" method from gaining widespread commercial acceptance.

The problem with all prior art winding systems of which Applicant is aware is that the means of passive or even active tension control is still too coarse for the most delicate linear media requirements and hence often damages the media. A number of prior art systems use a dancer pulley for tension control. However, the mechanical action of tension control using such a dancer pulley under high acceleration or deceleration profiles places an unacceptable impulsive force on the linear media and also often damages the media. Even for the closed loop control solutions implemented in the prior art, the methods used for tension measurement are either too inaccurate (such as using overall system weight) or too damaging to the media (using three-pulley tensiometers with small pulleys and reverse bends). Unfortunately, there is no current winding system that is capable of winding today's most delicate linear media, such as the extremely delicate, low-temperature superconducting reacted magnesium diboride ($MgB_2$) and niobium-3 tin ($Nb_3Sn$) based low temperature superconductor wires or manufacturing quality high temperature superconducting wires such as yttrium barium copper oxide (YBCO), bismuth strontium calcium copper oxide (BSCCO), or larger diameter fiber optical wire, without continual human intervention. This leads at best to long process times and poor quality control, as well as difficulties in meeting manufacturing repeatability standards, and at worst to media that is so damaged by the winding process that it can no longer be used for its original purpose or that has an extremely shortened operational life from poor media handling induced fatigue.

Thus, there is a need for an improved method and apparatus for handling delicate linear media and for winding such delicate media from or into a coil for use or storage.

SUMMARY OF THE INVENTION

It is an object of the invention, therefore, to provide such an improved method and apparatus for handling delicate linear media, such as reacted superconductor wire, and in particular for winding such delicate media onto a spool or bobbin. Preferred embodiments of the present invention carefully control the axial and lateral forces applied to the media during the winding process, and eliminate all small radius bends, reverse bends, and lateral bends as the media is handled, for example by winding the media into a coil. A combination of direct closed loop control and media routing design facilitates the handling of the delicate media without causing damage. The axial tension in the linear media may be closely controlled during winding by means of feedback control loop using tension measurements to control the rotation speeds of the wind-from and wind-to spools. Further, during winding, the delicate linear media is only exposed to large radius bends with no reverse bending.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF PREFERRED EMBODIMENTS

Figure 1:
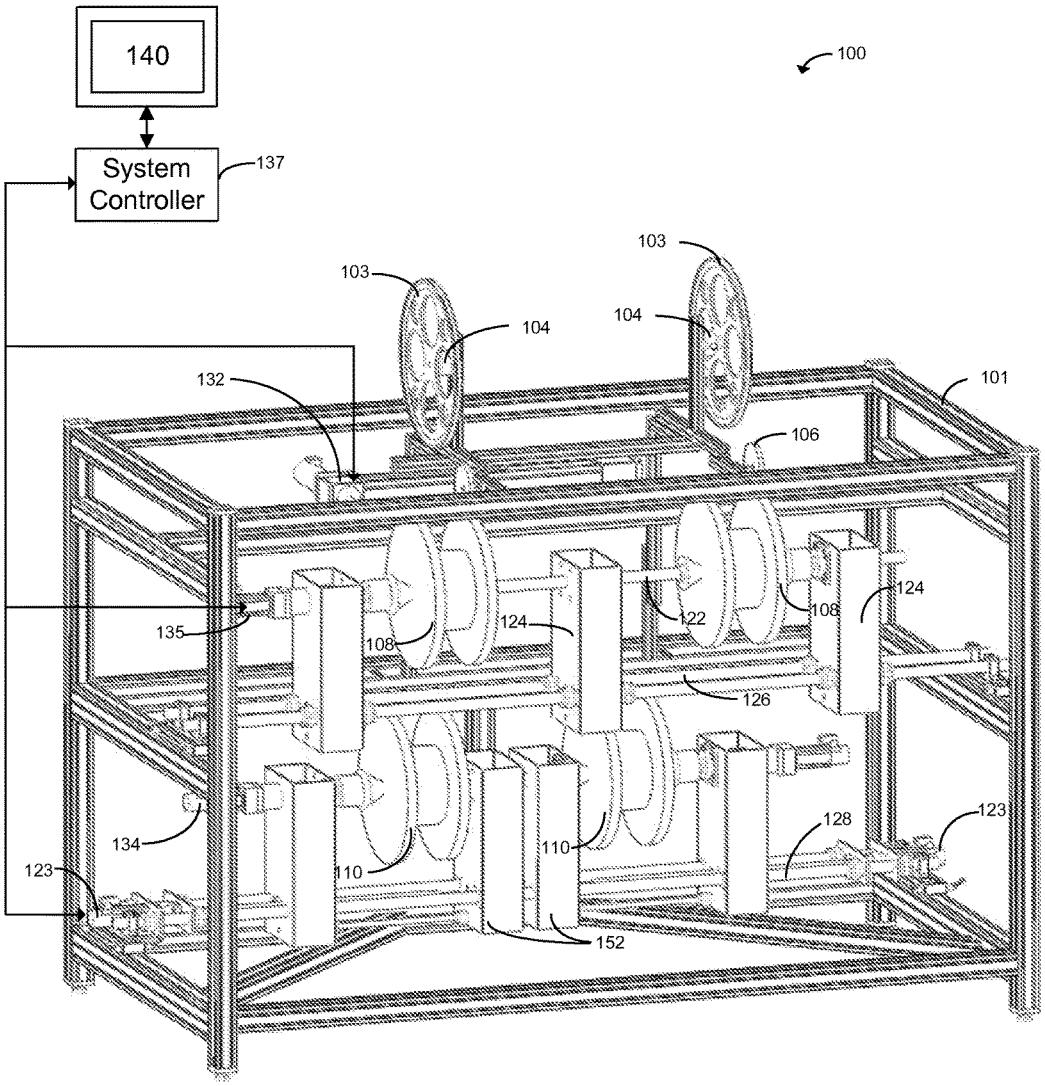
FIG. 1 shows an isometric front view of a linear media handling system according to a preferred embodiment the present invention.
Figure 2:
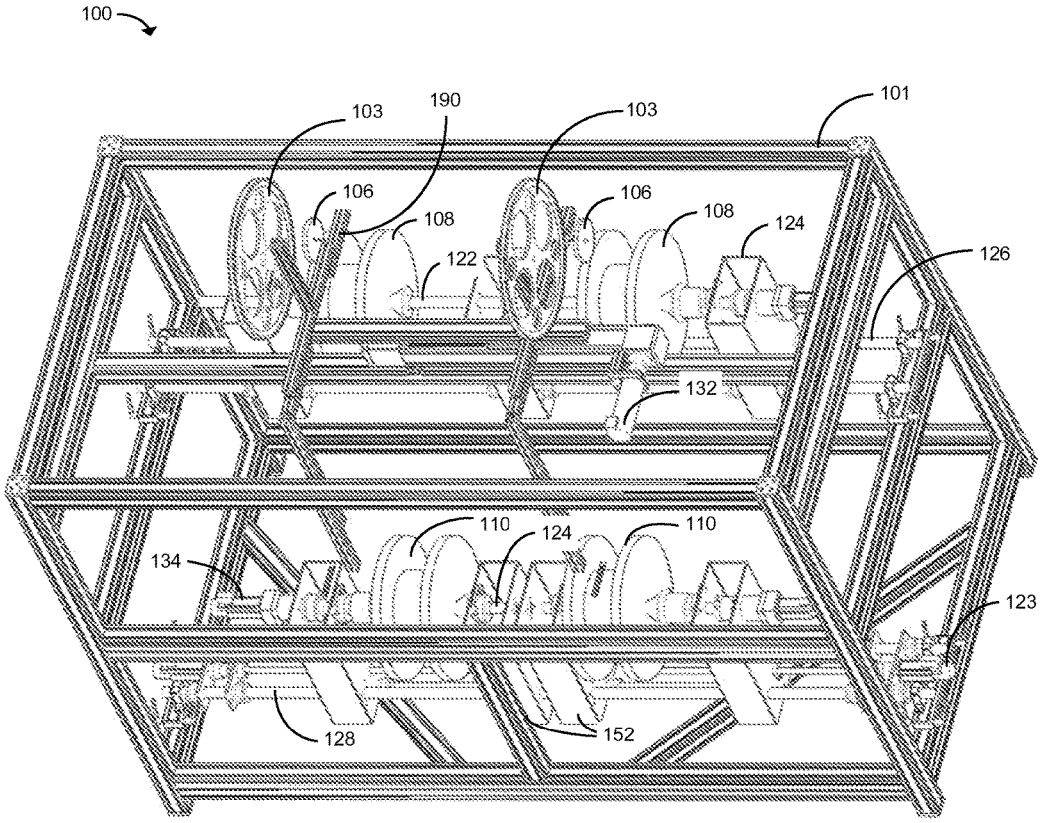
FIG. 2 shows an isometric top-down rear view of the embodiment of FIG. 1.

Preferred embodiments of the present invention are directed at a method and apparatus for handling delicate linear media, such as reacted superconductor wire. Previous attempts at handling these types of delicate linear media, including winding superconductor wire from one spool to another, have been largely unsuccessful and have typically resulted in damage to the media when attempting to achieve larger scale production quality or work with large-scale apparatuses. A successful method and apparatus for handling these types of delicate media must carefully control the axial and lateral forces applied to the media during the winding process. Accordingly, preferred embodiments of the present invention make use of a feedback control loop using tension measurements to control the axial forces applied to the media. Likewise, measurements of the lateral position of the wire can be used to adjust the relative positions of the wind-from and wind-to spools to minimize any lateral forces. Although the problem of damage to these types of delicate media during handling is well-known, Applicant has discovered that one source of this problem lies in the typical media routing path used by prior art winding systems. Preferred embodiments of the present invention thus eliminate all small radius bends, reverse bends, and lateral bends as the media is unwound from a storage spool and wound onto a different spool (or bobbin). Preferred embodiments of the present invention can also provide an automated means of moving and manipulating delicate media within a specified range of stress and strain measures without damage.

The most difficult design considerations for a winding machine according to the present invention are all based on the working requirements for extremely fragile, low-temperature superconducting wire/media. The desired flexibility to either wind onto a form and then react the wire or more preferably react the wire and then wind the now fragile wire product onto a form proves quite challenging for any winding machine. To Applicant's knowledge, automated or even manual powered machines with pseudo automation have yet to be produced to solve this problem. The challenges overcome by Applicant's invention include controlling the axial force applied to the wire to prevent damage yet maintaining enough winding tension for a proper bobbin lay-up, while maintaining the system requirements of no reverse bends, and large minimum bend radii. According to preferred embodiments of the present invention, this is accomplished through the use of an extremely accurate yet extremely low mass sensor system, high torque response with accurate position and angular change in velocity motor systems, unique mechanical designs to allow appropriate wire movement without adding to wire yield, and fast acting high fidelity closed loop controls to pull the entire system into a cohesive unit.

A preferred method or apparatus of the present invention has many novel aspects, and because the invention can be embodied in different methods or apparatuses for different purposes, not every aspect need be present in every embodiment. Moreover, many of the aspects of the described embodiments may be separately patentable. Preferred embodiments of the present invention minimize handling/winding damage to delicate linear media in a number of different ways, all of which are described in greater detail below with reference to the attached drawings.

Bend Radius Control

As the media is routed through the winding machine, it is also highly preferable that each bend, including the wind-from and wind-to spools and any pulleys over which the wire passes should maintain a minimum bend radius. This minimum radius, which can also be expressed as a minimum radius of curvature, is determined by the nature of the material being processed. Details of this relationship are discussed in the next paragraph. For handling reacted $MgB_2$ or $Nb_3Sn$ type delicate superconductor wire according to preferred embodiments of the present invention, the minimum bend radius should be at least 11 inches (27.9 cm), which is equal to a bend diameter of at least 22 inches (55.9 cm), for media which was reacted in a flat (i.e., approximately uncurved) state. The radius of curvature is used to determine the maximum stress point to which the media in question can be exposed without suffering mechanical damage.

On a media cross-section, distribution size scale, the radius of curvature is used to define the motion of the neutral axis with respect to the centroid of the material. Inside the material at a given radius of curvature, separation from the neutral axis provides compressive and tensile forces which determine the media stress and strain relations that contribute to material fatigue and failure points. Applied to wire routing, the radius of curvature can thus be used to determine the minimum bend radius allowable under various conditions. If magnesium diboride wire, for example, is reacted flat, then the reaction geometry including radius becomes the stress free point. The radius of curvature bend limit is then either a complete bend in one direction with no reverse bends, half of this bend radius value in either direction from the linear reaction point, or some other arrangement totaling the bend limit about the stress free radius. Similar philosophy dictates any starting stress free reaction process point and the associated bend radius limits. As an example, a typical winding according the embodiments of the present invention will use wire that has been reacted flat then bent in one direction with no reverse bends. This example reflects a typical use, but other radius of curvature options could also be employed. For example, a wire can be reacted while coiled, and the acceptable curvature would then be determined based upon the coiled position as a stress free point.

Linear Media Routing Design

Preferred embodiments of the present invention use a routing design that follows strict design rules in transferring liner media from a storage/reacting, wind-from spool to the desired wind-to spool (or bobbin). First, Applicant has discovered that it is highly desirable that the media routing path have no reverse bends whatsoever. As used herein, the term "reverse bends" is used to mean bending the media in one direction (for example by passing the media over a first pulley in a clockwise direction) and then bending the media in the opposite direction (for example by passing the media over a second pulley in a counter-clockwise direction). Such a desired path according to embodiments of the present invention is shown in FIGS. 1-6 where the media is always bent in the same direction (clockwise from the perspective shown in FIG. 5). Applicant has discovered that reverse bends, even minor reverse bends such as those used in many prior art tensiometers, can be very damaging to delicate media, including for example magnesium diboride or niobium-tin superconductor wire.

Dynamic Surfaces

In order to minimize media stress and strain through friction and rubbing (which not only increases axial tension on the media, but also tends to damage any wire insulation) all of the surfaces that are touched by the wire during the winding process will preferably provide a dynamic routing surface moving in the direction of the media motion (i.e., pulleys or wheels). The intent is to provide added protection for the linear media by allowing fewer or no static frictional surfaces, thus lowering the axial strain while protecting the surface of the media by ensuring that the coefficient of friction in the direction of media motion is a dynamic coefficient of friction rather than a static coefficient of friction, which would be the case if the media were sliding over a stationary surface.

Direct Closed Loop Axial Control

According to preferred embodiments of the present invention, axial tension is measured and used as input data for the primary control loop to control operation of the system. Preferably, closed loop control is used whereby the winding process is initiated by the operation of motors that turn either the wind-from spool or the wind-to spool (or both). The axial tension in the media during winding is measured and the output fed back to the system controller(s), which can adjust the speed of the spool rotations (both wind-from and wind-to spools) in order to keep the axial tension within a desired range. The axial tension must be low enough that the wire is not damaged. The upper limit for axial tension will depend upon the media, but for most superconductor wire applications, the steady state tension will be less than 5 pounds, more preferably less than 3 pounds. The greater the margin between allowable tension and sensor resolution (discussed below), the higher the throughput speeds that can be safely achieved. For most applications, the tension will need to be controlled to plus/minus a much smaller value (variance), preferably to within +/−0.1 pounds and even less for small winds. The axial tension will need to be high enough that the wire unwinds from the wind-from spool and onto the wind-to spool in the wire lay down manner and orientation desired. In most cases, an axial tension of at least 1 pound is appropriate for winding the wire. In extremely delicate cases the axial tension is readily controlled to around 0.5 pounds for even a medium sized wind and 0.1 pounds for a small wind. The greater the margin between sensor resolution (discussed below) and tension, the higher the throughput speeds that can be achieved.

Direct Closed Loop Lateral Control

Lateral bending and stress should also be controlled in preferred embodiments of the present invention. Superconductor wire should unwind from the wind-from spool, pass around the tension sensor wheel (preferably wrapped around approximately 180° circumferentially to ensure accurate measurement of the tension), and wind onto the wind-to spool while staying in substantially the same plane. In preferred embodiments, this is aided by a follower wheel located between the tension sensor wheel and the wind-to spool. The wheel and follower are preferably moveable so that they can maintain a position that is substantially in line with the desired position on the wind-to spool that will allow the media to be tightly wound onto the spool. If necessary, the lateral position of the wind-from spool can be changed to keep the portion of the media which is currently unwinding from the wind-from spool 110 in the same plane as the portion of the media which is winding onto the wind-to spool (or bobbin) 108. A material location sensor can be used to determine when the position of the wind-from spool 110 needs to be adjusted by linear motor 134 to maintain the proper lateral orientation to prevent damage to the media. As used herein, maintaining the wind-off and wind-on points of the two spools, as well as the tension sensor wheel, in substantially the same plane means maintaining the positions of those points close enough to the same plane that the lateral tension on the delicate linear media does not exceed 10% of the maximum axial tension limit for the particular winding task.

Media Orchestrating Routing Technology

Another embodiment of the invention includes a versatile system for quick media alignment and movement called Media Orchestrating Routing Technology (MORT), described below. MORT is the foundation for both wind-from and wind-to spool attachment to the linear motion structure and provides a high tolerance alignment during motion of the linear media even with multiple degrees of freedom through the use of a single piece of primary structure material (i.e., supports 124 described below). MORT allows for media insertion and removal via front, side, or top loading and unloading options whether sliding the load across the holding shaft or incorporating a shaft removal section at the load location. Although a tailstock is readily possible with MORT, MORT can also be used to hold a large spool without the use of a tailstock via a cantilevered system. According to preferred embodiments of the present invention, the MORT system, including the supports described below, can be configured to allow an adequate degree of freedom, both linear and rotational, to provide and control media routing.

DoF Controls

As used herein, the term DoF will be used to describe control of the routing elements and structures to adjust the orientation of the elements and structures to provide linear and/or rotational degrees of freedom to facilitate the handling of the delicate media without causing damage. For any motorized single or combination of DoF, independent or electronically geared control of linear media motion is possible through automated, partially automated, and fully manual means. Options include a hardware joystick, a software joystick, or partially automated motion controls that allow turning on/off a single to multiple DoF for a particular move. Such ability allows the user to tune the motion for a particular need. Preferably, automated, partially automated, and/or fully manual control of any motorized single or combination of multiple DoFs is accomplished to achieve motion while accurately maintaining desired performance values such as constant axial tension. In examples described below, for example, a motorized DoF provides a continuous or changing winding pitch angle. Active control loops based on the axial tension value as the global control master and a hierarchy of master slave relationships provide the means of varying the pitch angle while accurately maintaining desired performance values such as constant axial tension.

Angle on/Off Wind

Figure 7:
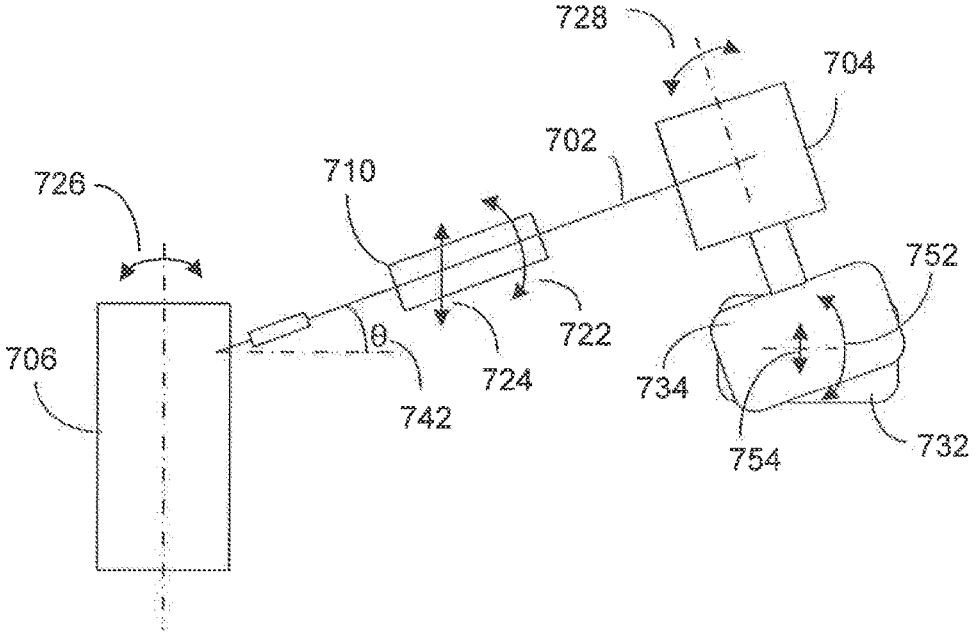
FIG. 7 shows one embodiment of the invention which allows a continuous or changing angle from the spool wind off.
Figure 8:
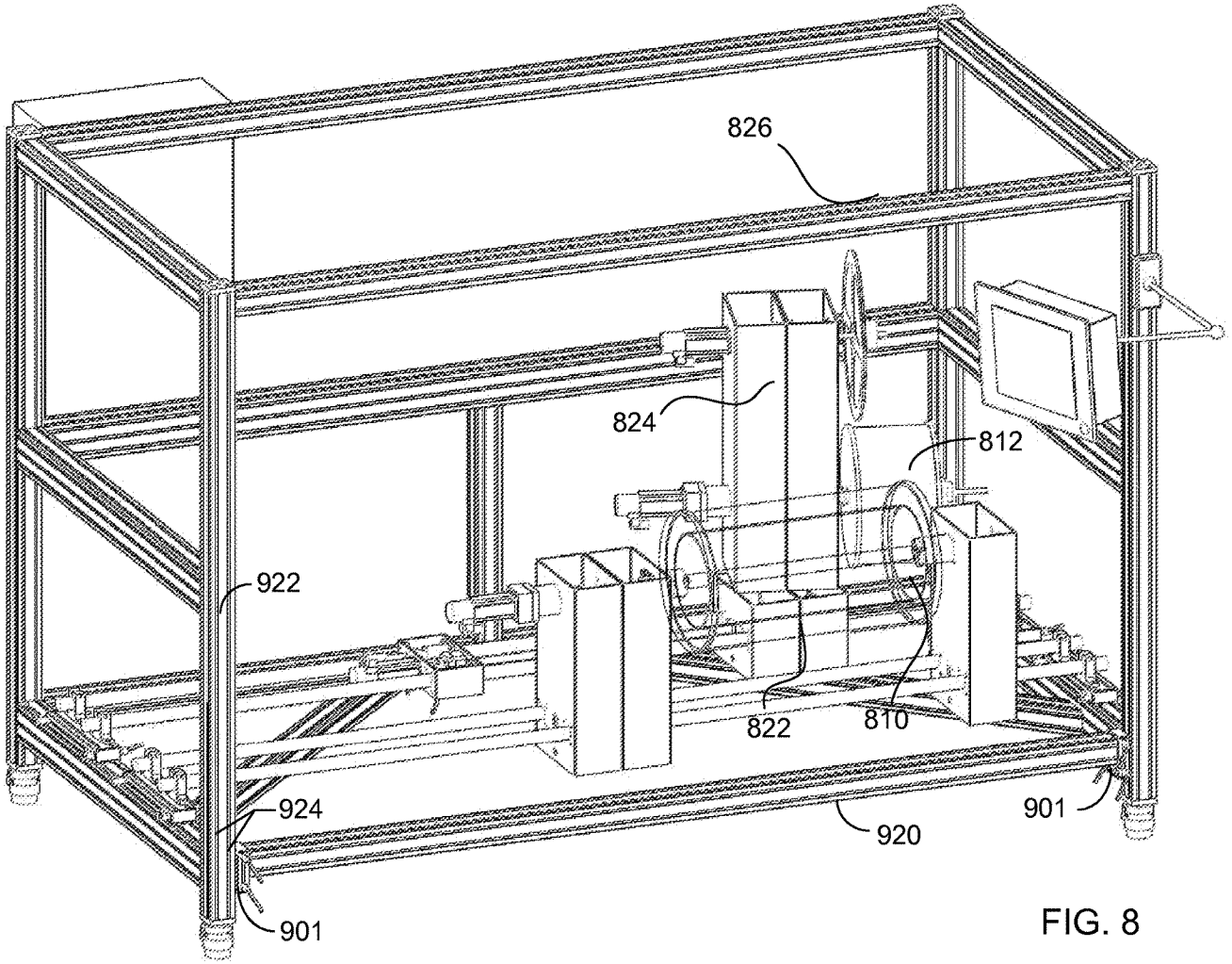
FIG. 8 is an illustration of the embodiment shown in FIG. 7 as part of the linear media handling system.

One means of an optional, specialized winding allowance is accomplished by an additional active DoF providing a continuous or changing pitch angle from the wind-from spool, across the sensor systems such as axial tension, and into the wind-to spool (FIG. 7 provides a schematic and FIG. 8 provides an illustrated view of this additional DoF). Active control loops based on the axial tension value as the global control master and a hierarchy of master slave relationships provide the means of varying the pitch angle while accurately maintaining the desired performance value such as constant axial tension. Prime examples of need are a tape media winding or helical winding where the wind-to spool must assume a special angle for the winding yet the angle from the wind-to spool back to the wind-from spool must be constant or a set varying value. A practical solution is achieved through the addition of rotational DoF on the spool and all wire routing mechanisms working in conjunction with current linear and rotary motion mechanisms. Such capabilities expand into automatically to semi automatically controlling the complete wind on/off angles for any system for any desired need.

End of Layer Sense

A critical transition in windings occurs when the edge of a wind-to spool is encountered. In multilayer windings a change in direction must be negotiated at this transition. A sense mechanism is provided to determine the end of layer conditions. This helps provide additional active precision control feedback to assist with conventionally human interaction and increases winding throughput without errors. Sensing can be accomplished with any number of mechanisms including inductive proximity sensors, mechanical contact, and optical sensors.

FIGS. 1-5 illustrate an embodiment of the present invention that satisfies the requirements described above with respect to delicate linear media, such as superconducting wire. Typically, superconducting wire will be wound onto a spool and then reacted as described above. A spool of reacted superconductor wire from which the wire is to be removed (the wind-from spool) is loaded onto the lower spool position. The system according to preferred embodiments of the invention shown in FIGS. 1-4 is a dual system, with the capacity for two different wind-from spools and two wind-to spools. Other system configurations are possible within the scope of the invention, including systems with N wind-from and N wind-to spools, where N may be one or N may be greater than two. The wire is not shown in these figures for purposes of clarity in illustrating the apparatus components. Although in the preferred embodiment shown in FIGS. 1-5, the wind-from spool is the lower spool and the wind-to spool is an upper spool, any orientation could be used, including for example a reverse arrangement or two spools side-by-side at the same height.

Figure 9:
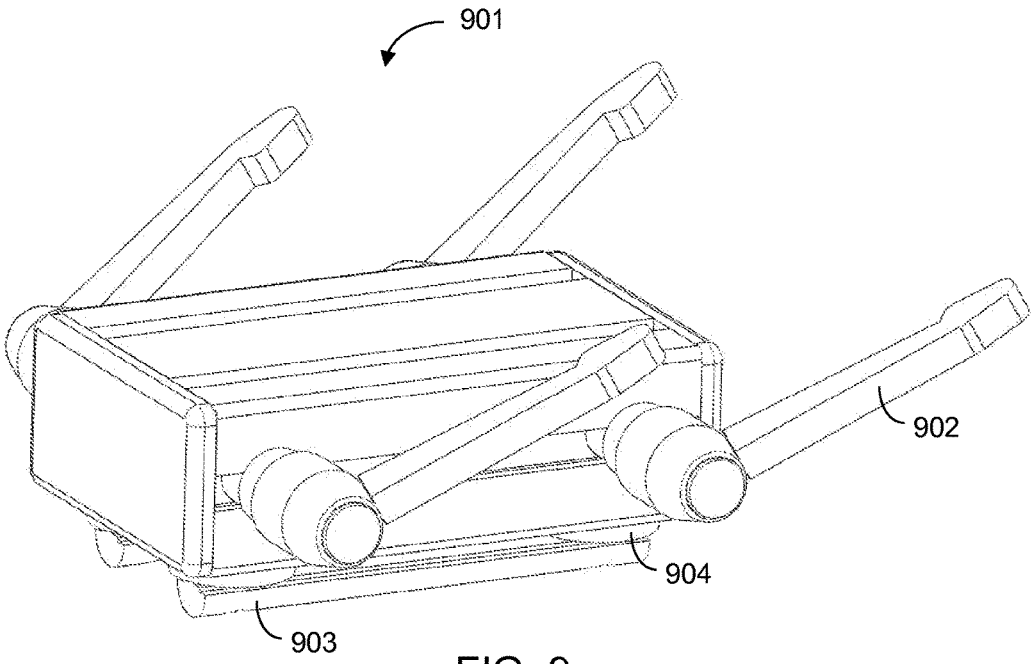
FIG. 9 is an illustration of a carriage that can be used to move and/or lock components of the media handling system in place The accompanying drawings are not intended to be drawn to scale. In the drawings, each identical or nearly identical component that is illustrated in various figures is represented by a like numeral. For purposes of clarity, not every component may be labeled in every drawing.

Wire winding machine 100 comprises a frame 101 that supports the various components of the apparatus. Preferred embodiments of a wire winding machine according to the present invention can make use of commercially available framing systems using metal frame elements that can be mounted together in any desired configuration. In the embodiment of claim 5, the frame elements form a rectangular box shape, with various cross members for additional structural support. Referring also to FIG. 9, preferred embodiments of the present invention can make use of the novel Multipurpose Modular Platform (MMP) Carriages that allow frame elements within the overall outer frame to be readily moved and locked into place, whether in a no-load or high load setup. Such allowance provides for readily manipulating frame elements into new process configurations not possible with regular extrusion setups. Using MMP Carriages, it is possible to accommodate the manual positioning of both the wind-from and wind-to spools into any 3D location within the frame. Preferred embodiments of a wire winding machine according to the present invention can also include a gantry or crane system for the purpose of readily moving a load within the overall frame either within a single process station or to transfer a load between multiple stations.

Lower spool 110 (the wind-from spool) will typically be loaded with reacted superconductor wire, which is being transferred to upper spool 108 (the wind-to spool). Rotational motors 134 and 135 can cause the lower spool 110 and upper spool 108, respectively, to rotate in order to unwind the reacted wire from the lower spool 110 and wind it onto the upper spool 108. Rotational motors 134 and 135 can preferably be operated independently of one another.

Figure 5:
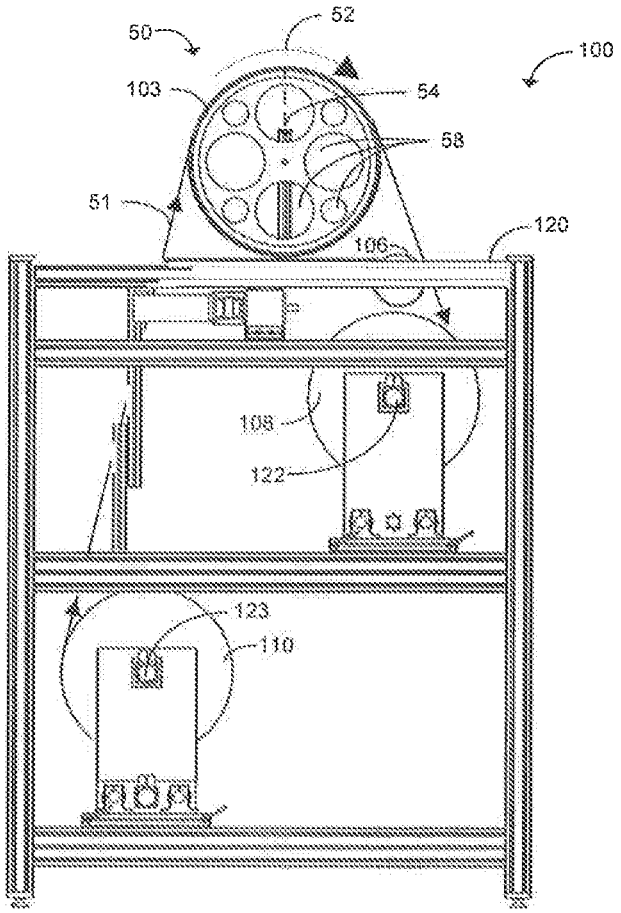
FIG. 5 shows a side view thereof.
Figure 6A:
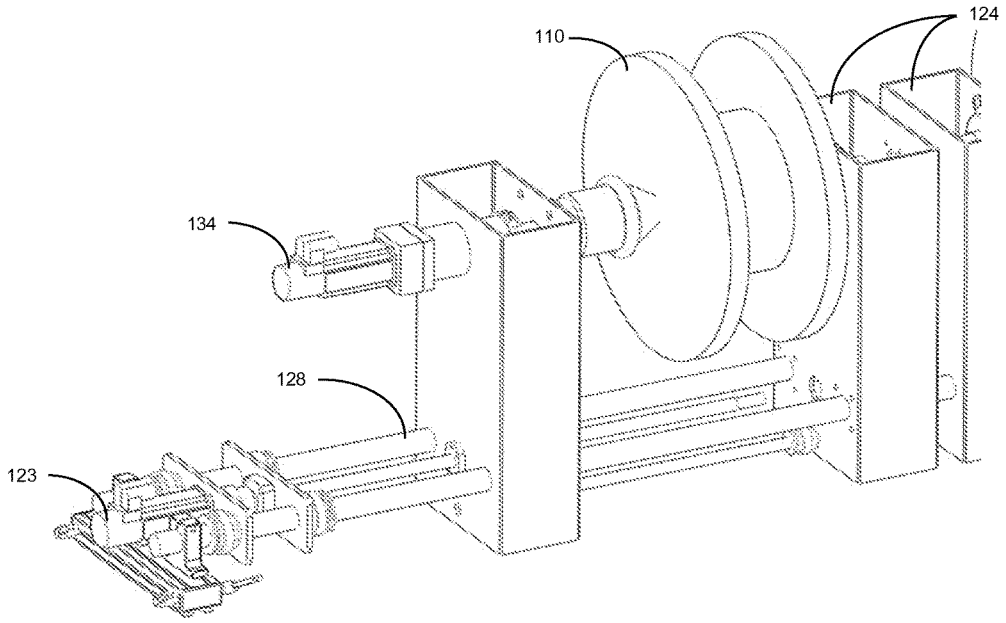
FIG. 6A shows an isometric view of the shaft supports and the shaft support rods according to a preferred embodiment the present invention.
Figure 6B:
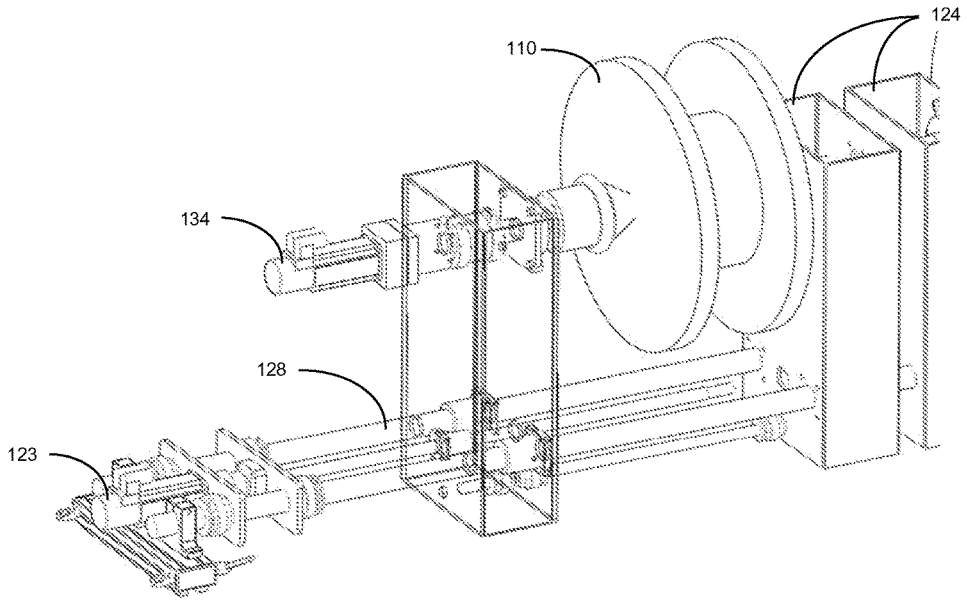
FIG. 6B shows a view of FIG. 6A with one of the supports shown as transparent.

Referring also to FIG. 5, wire from the lower spool 110 would be fed up and over the tension wheel 103 of the wire tension sensing system 50 in the direction shown by arrows 51 and 52. According to preferred embodiments of the present invention, the wire tension sensing system 50 is used as the primary control loop for the operation of the entire apparatus. This can be referred to as direct closed loop axial control, which is developed by directly sensing the axial tension on the linear media. The determination of axial tension can be problematic for delicate linear media. Many types of prior art tension measuring systems inherently induce some additional tension onto the media through the use of multiple pulleys or levers contacting the moving media. Further, many prior art tension measuring systems introduce small diameter bends and even reverse bends to the linear media. Either of these situations can destroy delicate media such as superconductor wire.

The accurate determination of axial tension without damaging the delicate linear media can be accomplished, for example, by the novel wire tension sensing system 50 according to the present invention. The wire tension sensing system 50 of the present invention makes use of a tension sensor wheel 103 and a tensiometer 104 (see also FIGS. 1-3).

Because the tension sensing system should have no reverse bends, it is preferred that only one tension sensor wheel 103 is used, instead of the more common three-pulley tensiometers of the prior art. A single wheel system is also advantageous because the complexity of wire/media routing is minimized and there is less chance of fouling the wire surface or fibers. The preferred arrangement between the wind-from spool 110, the tension sensor wheel 103, and the wind-to spool 108 incorporates a bend around tension sensor wheel 103 (as shown by line 52 in FIG. 5) that is close to 180 degrees for a better tension measurement. Because of the sizes of the spools (loaded and unloaded) and the other components of a winding machine according to the present invention, it will often be impractical to use a 180-degree bend around the tension sensor wheel. In the embodiment shown in FIG. 5, the bend is approximately 160 degrees. Any measurement error resulting from the angle will be small enough that it can be ignored. Alternatively, the error can be corrected for during the axial tension calculations. In some preferred embodiments, angles as low as 60 degrees could be used.

The media is passed over wheel 103 which is supported by a center bolt 305 (see also FIG. 3) that is part of the tensiometer system 104. A known Wheatstone bridge arrangement allows the stress applied to the bolt to be measured to a high degree of accuracy. Persons of skill in the art will recognize that the center bolt 305 will also be stressed by the weight of wheel 103. The weight of the wheel 103 will need to be zeroed out in order to measure only the strain on the shaft caused by the delicate media. According to preferred embodiments of the present invention, the tension on the media can be calculated (preferably by software operating on a computer memory) from the angle of the wire, the diameter of the wheel 103, the temperature, and the stress applied to bolt 305 using a known calculation. For most applications, the angle of the wire will not change enough to be significant, but where there is a large change (which might result from a relatively large amount of wire wound onto or from a narrow spool) the angle will have to be calculated. In some preferred embodiments, the wire angle can also be sensed by an appropriate sensor using known techniques.

While such a wheel and tensiometer arrangement is known in the art, Applicant has discovered that the bend radius requirements for the storage spools must also be applied to this type of tension sensing wheel in order for the apparatus to determine the media's axial tension in order to handle the media without damage. Accordingly, when winding, for example, magnesium diboride superconductor wire, wheel 103 will preferably have a diameter of at least 22 inches.

The relatively large size of the wheel causes a number of problems for the tension sensing system 50. Because the tensiometer arrangement for measuring the stress applied to the center bolt 305 needs to be able to accurately sense very small forces (typically less than 3 pounds) a large, heavy wheel will typically weigh so much that it will damage or degrade the performance of a sensor with a measurement range that covers such small forces. For example, if a very heavy wheel is used, the very small forces that are allowable for axial tension of a delicate media will make up only a small portion of the total force applied to the center bolt (with the large majority being the mass of the wheel). The forces to be measured will thus be largely lost within the system noise and measurement accuracy will be very low. Sensor resolution tends to be expressed as a percentage of the total measurement range of the sensor. For example, if a family of sensors has a resolution of 0.5%, a sensor capable of measuring up to 50 pounds for example, would have a resolution of 0.25 pounds. Obviously such a sensor would not be able to allow the system to control axial tension to within +/−0.1 pounds as discussed above. A sensor with a higher resolution, however, would have a correspondingly lower measurement range. For example, a sensor with a range of 11 pounds would have a resolution of approximately 0.05 pounds. Such a sensor would provide the required resolution to control axial tension to within +/−0.1 pounds, but the total weight of the wheel and the tension (the desired tension could be on the order of 3-5 pounds, for example) must be within the sensor's measurement range. Skilled persons will realize that it is preferable that the sensor resolution actually be as low as possible in relation to the allowable axial tension tolerances.

Therefore the axial tension sensor wheel, the primary control feedback mechanism, should be as low as possible in overall mass to stay within the precision sensor limits to maintain a precise measurement as well as to allow the feedback motors to properly and safely control the media motion. The overall mass directly relates to the sensor range and accuracy limits possible for a reading and preferred values are case dependent for desired sensor feedback.

As a result, it is preferable that wheel 103 be formed from a very lightweight material and that the wheel itself have a number of cutouts 58 to reduce the overall weight of the wheel. In one preferred embodiments of the present invention, the wheel will weigh no more than 10 pounds, despite having a radius of 11 inches; more preferably, the wheel will weigh 5 pounds or less. The maximum allowable weight of the measurement wheel itself is dependent upon the axial forces being measured and the required sensor resolution. For example, where the maximum allowable axial force on the delicate linear media is 3 pounds, and the required tension tolerance (variability) is +/−0.1 pounds, the maximum preferred wheel mass would be approximately 7 pounds (for a resolution that is approximately half of the allowable tension tolerance).

Wheel 103 will also preferably have a very evenly distributed and uniform mass around the circumference. Any variation in mass can introduce inaccuracies in the axial force determination, which can be very detrimental to safe media handling. In preferred embodiments of the present invention, the wheel's angular variation in mass will be no more than 1/10 of the desired winding (axial) tension tolerance resolution. In some preferred embodiments, minor variations in mass can be compensated for by calibrating the wheel and adjusting the sensor signal accordingly. Preferably, the wheel can be formed of a lightweight plastic or carbon fiber material, although any suitable lightweight material could be used that is rigid enough to support the wire and maintain a uniform mass around the circumference of the wheel. A suitable wheel can be manufactured by any suitable means, including for example, injection molding, 3-D printing, or stereolithography.

By using direct closed loop axial control as described herein, the delicate media can be unwound from the wind-from coil 110 and wound onto the wind-to coil 108 without producing an axial load that will damage the media. As the media is being transferred from one spool to the other, if the axial tension rises to a preset threshold, the system controller 137 will operate to compare the sensed axial tension to the preset threshold and then to reduce the tension, for example by speeding up the rotation of the lower wind-from spool 110 by a small amount. If the tension falls too low, the rotation of the wind-from spool 110 could be slowed by a small amount. In a preferred embodiment, the rotational speeds of both spools can be controlled so that the system can maintain a proper media tension at the desired winding speed. Operation of the system controller 137 can be programmed via computer and monitor 140.

Figure 3:
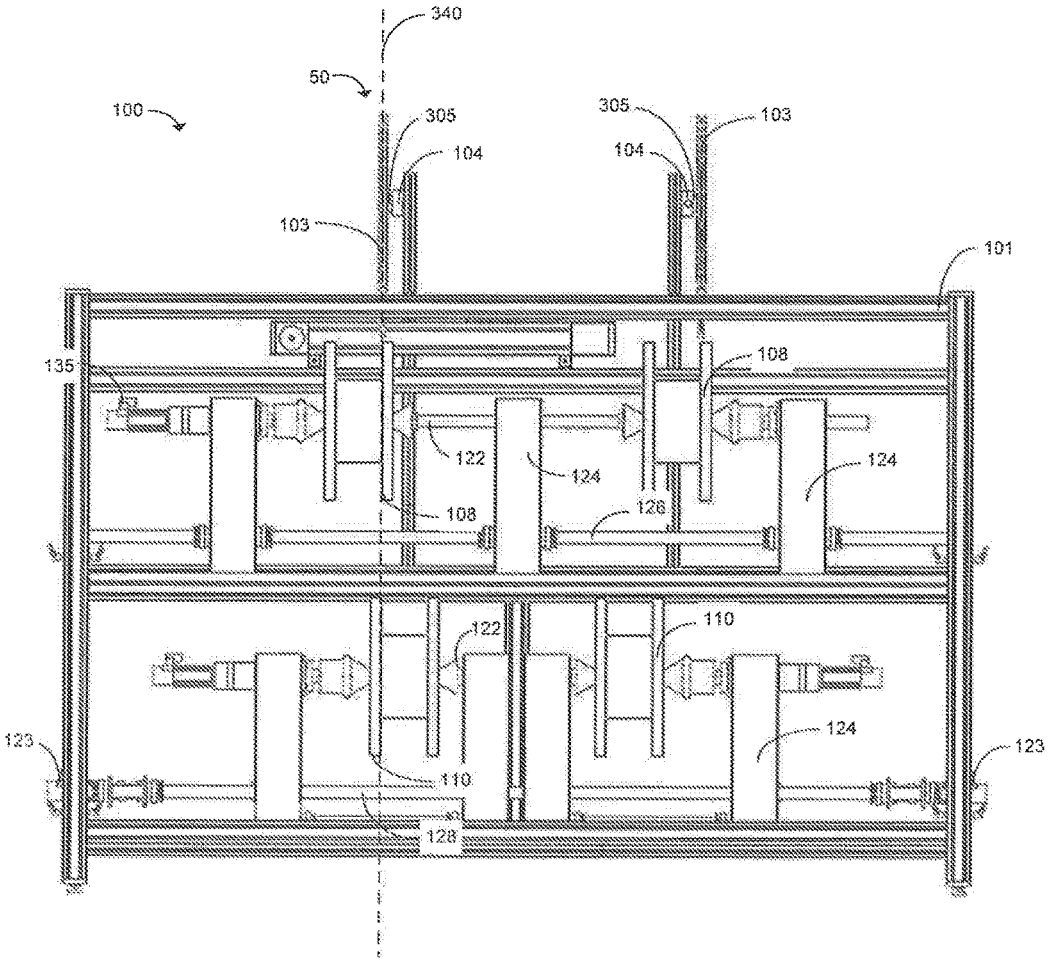
FIG. 3 shows a front view thereof.
Figure 4:
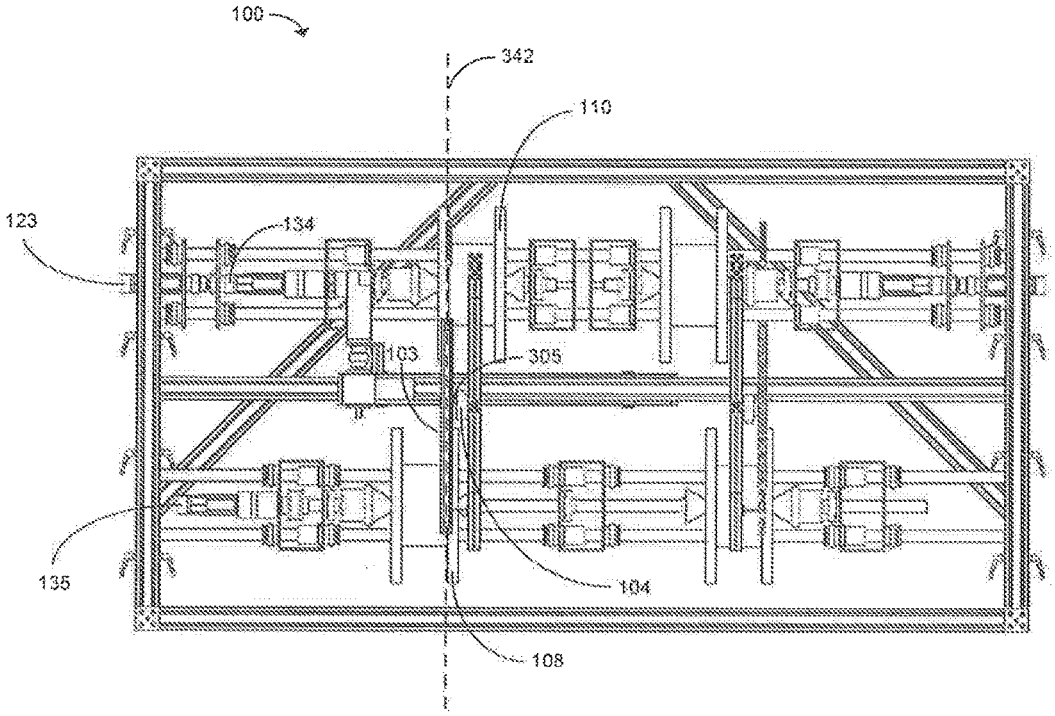
FIG. 4 shows a plan view thereof.

As described above with respect to Direct Closed Loop Lateral control, it is also preferable that any lateral stress on the wire as it is wound from the lower spool 110 to the upper spool 108 be eliminated, or at least minimized to no more than 1/10 of the maximum allowed axial tension. In preferred embodiments of the present invention, this is accomplished by maintaining the wind-off and wind-on points of spools 110 and 108, respectively, as well as the tension sensor wheel 103, in substantially the same plane. This is illustrated in FIGS. 3 and 4 by dashed lines 340 and 342, respectively. As shown in FIG. 3, while the left-hand (as viewed from the front of the system 100) winding system is being used, wire would be winding off the far left of lower wind-from spool 110. The wire would then pass over tension wheel 103 and back down to wind onto the far right of upper wind-to spool 108. The positioning of the wire with respect to the upper spool 108 is aided by a follower wheel 106 (see FIGS. 2 and 5) located between the tension sensor wheel 103 and the wind-to spool 108. The wheel 103 and follower 106 are preferably moveable so that they can maintain a position that is largely in line with the desired position on the wind-to spool 108 that will allow the media to be tightly wound onto the spool. Preferably, lateral movement of the wheel 103 and follower 106 is accomplished by motor 132 and controller 137, which can be programmed to move the wheel 103 and follower 106 into the proper position by taking into account factors such as the winding speed and the size of both the media and the upper spool 108.

The lateral position of the wind-from spool 110 can be adjusted by linear motor 134 and a controller 137. Adjustment will frequently be necessary when, for example, the wind-from and wind-to spools are of different sizes. In FIG. 3, the position of lower spool 110 has been adjusted along lower spool center support rod 128 by linear motor 123 so that the far left portion of spool (the wind-off position in this example) 110 is also located in plane 340.

FIG. 4 shows a different view of the same point in the winding process. The wind-off location is at the far left of lower spool 110, while the wind-on position is at the far right of the upper wind-to spool 108. Skilled persons will recognize that the arrangement (i.e., planes 340 or 342) need not be at either extreme of spools 110 or 108, and rather any appropriate portion of lower spool 110 (depending on the wind-off location) can be positioned so that it is in the same plane as the wheel 103 and follower 106 and as the wind-on location of the upper wind-to spool 108.

This type of lateral control requires a sensor capable of determining the location of the wire unwinding (the wind-off point) from the wind-from spool 110. In preferred embodiments, the sensor used to sense the media lateral position for the direct closed loop lateral control system is simply a rotational position-sensing encoder turned into an angle position system by placing a pair of low mass, parallel, adjustable separation bars on the sensor shaft. The media is routed through these parallel bars 190 (see FIG. 2), which have a center that is in substantially the same plane as the follower. The sensor angular position indicates if the media is too far to one lateral side or another with respect to the follower plane and therefore moves the wind-from spool to realign the spool wire wind-off with the follower plane. The lateral positioning sensor thus forms another closed control loop controlling the lateral position of the lower wind-from spool. Typically, the lateral position of the lateral positioning sensor and follower relative to the upper wind-to spool can be programmed based upon the spool and media sizes to produce a tightly wound coil.

The end of the travel media-follower guides allows a tight tolerance condition. Two primary mechanisms provide this ability. This first mechanism is a manually or automatically adjustable axis of the wire guide towards the media in the wind-to spool to precisely control the media lay-up. The second mechanism is to manually or automatically have the wire-guide side approaching the end of the follower travel move beyond the interference position posed by the follower travel and/or spool side next to the media itself and thereby allow the end of travel limits to extend to the true end of the wind-to spool and/or spool media lay-up. This end of limit follower guide prior to reversing the follower direction will be activated either passively via a mechanical mechanism or through the linear motion end of limit switch. Both mechanisms are used to provide a tighter and more even media-packing factor through the full media positioning control length of the wind-to spool.

In the winding system 100 of FIGS. 1-6, the spools and center rods are supported by a number of modular supports 124 that provide a simple and cost-effective method of construction. Supports 124 are preferably formed from a rectangular extrusion of, for example, aluminum or an aluminum alloy. A hole bored with a high degree of accuracy on the centerline in each extrusion is fitted with a bushing that supports the center shafts 122 of the spools and ensures they are aligned with these centerline openings. Supports 124 are held in position relative to the frame 101 by support shafts 126 and 128. Preferably at least two support shafts 126 or 128 are used for each support 124 to provide both vertical support and rotational alignment. In this way, the positions of the components can be maintained within tolerances. Supports 124 also provide an extremely robust mounting structure through the uniquely large separation of the large diameter parallel support shafts 126 and 128 for a relatively affordable cost. Supports 124 are a central feature of the MORT technology, described above, that allows a reduction in both part count and tolerance stack up between the linear motion and the rotary motion. Tailstocks 152 provide additional support for wind from spool 110 and in some embodiments are exactly identical to supports 124. Those skilled in the art will recognize that MORT technology can function via a cantilevered system to hold a large spool without the use of a tailstock.

FIG. 7 shows another embodiment of the present invention which incorporates an angle on/off wind and allows a continuous or changing angle from the spool wind off. Media 702 is unwound from wind-from spool 704 and wound onto a wind-to spool 706 at an angle 742. A follower 710 is a sensor system that measures axial tension. Follower 710 can rotate with rotational degree of freedom 722 and can also move linearly with linear degree of freedom 724. Wind-to spool 706 and wind-from spool 704 also have rotational degrees of freedom, shown as 726 and 728, respectively. Wind-from spool 704 is held in place by spool supports 732 and 734. Support 732 has linear degree of freedom 754, while support 734 has rotational degree of freedom 752. The combination of both linear and rotational degrees of freedom provides a means of varying the set or changing angle relationship while maintaining constant axial tension. Active control loops based on the axial tension value as the global control master and a hierarchy of master slave relationships from that top level master provides the means of varying the set or changing angle relationship while accurately maintaining the desired performance value such as constant axial tension. This embodiment allows additional active degrees of freedom, which suits needs such as a tape media winding or helical winding, where the wind-to spool must assume a special angle for the winding yet the angle from the wind-to spool back to the wind-from spool must be constant or a set varying value. Those skilled in the art will readily recognize that the angle of the winding can be changed to fit the desired application and the capabilities of this embodiment can be controlled automatically as well. Not so easily recognized is that this rotational system, coupled with the tension feedback controlled rotation of the wind-from spool and the wind-to spool comprise a capable system that permits the graceful transition from winding in one axial direction to the opposite direction while maintaining a tight tolerance on continuous tension.

FIG. 8 is an illustration of the embodiment shown in FIG. 7 as part of the linear media handling system. For clarity purposes, spool 810 is shown transparent. Wind-from spool 812 is supported by supports 822 and 824. Bottom supports 822 and top supports 824 are physically connected, but bottom supports 822 are functionally split from top supports 824 such that bottom supports provide linear movement while the top supports provide rotational movement. A tension sensor wheel 826 is used to measure axial tension. Preferably, winding can be performed either at a constant or varying angle in a manner that prevents folding or puckering for certain tape media or other non-cylindrical media applications. Changing the pitch angle 742, the angle the media is to be wound on to the wind-to spool, without any other movement creates a kink in the linear media that can exceed allowable stresses in the media. Rotation of the wind-from spool and the wind-to spool as pitch angle changes is preferably controlled to avoid any kinks or puckers. In this embodiment, an active control loop uses tension information to control the rotational and linear movement in order to maintain a desired tension. The axial tension in the media during winding is measured and the output fed back to the system controller(s), which can adjust the speed of either or both of the spool rotations (both wind-from and wind-to spools) in order to keep the axial tension within a desired range. Persons skilled in the art will readily appreciate that the active control loop can be automated to maintain a desired tension.

FIG. 9 is an illustration of a carriage 901 that can be used to move and/or lock frame elements. Four handles 902 are rotated and pull up on machined T-slot bars 903. Referring also to FIG. 8, carriages can be permanently attached, for example, at the end of a support beam such as lower horizontal support beam 920. The T-slot bars 824 slide into slots 924 of another beam such as vertical support 922. Rotating the handles pulls on the support into which the T-slit bars are slotted and compresses the upper (toward the carriage) surface of that beam against polymer washers 904. The washers 904 allow for the carriage to slide easily when not locked and provide for even spacing when clamped to lock the carriage in place against the attached beam. By mounting equipment or parts of our assembly to these carriages, the carriages can be loosened to allow linear motion is along support beams and then clamped into place at any desired location. Other known methods for removably clamping support beams could also be used.

Although the description of the present invention above is mainly directed at a superconductor wire, it should be recognized that the invention could be applicable to any delicate linear media. As used herein, the term "delicate linear media" will include low and high temperature superconducting wire, very fine conventional wire, fiber optic wire, thin strands of carbon based fiber, smart fabrics, or extremely dense fine fiber matrices for impact or extreme environment protection. Further, the present invention can be applied not only to coil winding but also to any other delicate media handling process including but not limited to media insulating, bending, braiding, forming, splicing, heat or chemical treatment such as reacting, encapsulation, inspecting, and any manual or automated process that requires handling the media safely. As used herein, the terms "wire," "cable," and "media" are used interchangeably. Preferred embodiments of the present invention can be applied to allow an automatic winding (or other similar) process. Also, the term "spool" is used herein to refer to any object onto which the delicate liner media is wound, regardless of the object's shape. Industry language commonly refers to a wind-from spool as "spool" and wind-to spool as "former" or "bobbin," and those terms may also be used interchangeably herein. Whenever the terms "automatic," "automated," or similar terms are used herein, those terms will be understood to include manual initiation of the automatic or automated process or step.

It should also be recognized that embodiments of the present invention can be implemented via computer hardware or software, or a combination of both. The methods can be implemented in computer programs using standard programming techniques—including a computer-readable storage medium configured with a computer program, where the storage medium so configured causes a computer to operate in a specific and predefined manner—according to the methods and figures described in this Specification. Each program may be implemented in a high level procedural or object oriented programming language to communicate with a computer system. However, the programs can be implemented in assembly or machine language, if desired. In any case, the language can be a compiled or interpreted language. Moreover, the program can run on dedicated integrated circuits programmed for that purpose.

Further, methodologies may be implemented in any type of computing platform, including but not limited to, personal computers, mini-computers, main-frames, workstations, networked or distributed computing environments, computer platforms separate, integral to, or in communication with charged particle tools or other imaging devices, and the like. Aspects of the present invention may be implemented in machine readable code stored on a storage medium or device, whether removable or integral to the computing platform, such as a hard disc, optical read and/or write storage mediums, RAM, ROM, and the like, so that it is readable by a programmable computer, for configuring and operating the computer when the storage media or device is read by the computer to perform the procedures described herein. The invention described herein includes these and other various types of computer-readable storage media when such media contain instructions or programs for implementing the steps described above in conjunction with a microprocessor or other data processor. The invention also includes the computer itself when programmed according to the methods and techniques described herein.

The invention has broad applicability and can provide many benefits as described and shown in the examples above. The embodiments will vary greatly depending upon the specific application, and not every embodiment will provide all of the benefits and meet all of the objectives that are achievable by the invention. In the previous discussion and in the claims, the terms "including" and "comprising" are used in an open-ended fashion, and thus should be interpreted to mean "including, but not limited to . . . ." To the extent that any term is not specially defined in this specification, the intent is that the term is to be given its plain and ordinary meaning. The accompanying drawings are intended to aid in understanding the present invention and, unless otherwise indicated, are not drawn to scale.

Although the present invention and its advantages have been described in detail, it should be understood that various changes, substitutions and alterations can be made to the embodiments described herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

I claim:

1. A winding machine for use with delicate linear media, comprising:

a wind-from spool configured to store delicate linear media;

a first motor configured to move the delicate linear media from the wind-from spool;

a wind-to spool, said wind-to spool being the spool onto which at least a portion of the delicate linear media removed from the wind-from spool is to be wound;

a second motor for rotating the wind-to spool to wind the delicate linear media onto the wind-to spool;

at least one support interconnected to the wind-from spool that allows the wind-from spool to at least one of move laterally and angulate to selectively control the angle of the delicate linear media with respect to the wind-to spool;

a wire tensioning system for sensing the axial tension in the delicate linear media during operation of the winding machine, said wire tensioning system comprising a tensiometer and only a single tension sensor wheel;

a system controller to receive the sensed axial tension and to control the first and second motors to maintain a desired axial tension in the delicate linear media; and wherein during operation the delicate linear media is not exposed to a bend having a diameter less than 22 inches.

2. The winding machine of claim 1, further comprising:

a follower wheel located between the tension sensor wheel and the wind-to spool and positioned so that the delicate linear media from the wind-from spool passes over the follower wheel before winding onto the wind-to spool, said follower wheel being moveable to control the lateral position of the delicate linear media as it winds onto the wind-to spool;

a sensor capable of determining the location of the wire unwinding from the wind-from spool and a lateral positioning motor for adjusting the lateral position of the wind-from spool; and wherein the sensor is used to control the lateral position of the wind-from spool so that the wind-off point and the follower wheel are maintained in approximately the same plane.

3. The winding machine of claim 1, in which a structural element is used to geometrically couple the rotational movement and lateral movement of the wind-from spool, said structural element providing parallel mounting surfaces for mounting linear and rotary bearings that support these movements.

4. The winding machine of claim 3, wherein said structural element is divided horizontally into an upper and a lower section and in which the upper section can be axially rotated with respect to the lower section to accommodate rotation of the wind-from spool axis in the horizontal plane and to allow control of the pitch angle of the delicate linear media being wound onto the wind-to spool.

5. The winding machine of claim 1, wherein a user interface is provided to control the rotation of the wind-to spool and the lateral movement of a wind-on point on the wind-to spool.

6. The winding machine of claim 1, wherein during operation the delicate linear media does not pass through any reverse bends.

7. A method for winding a delicate linear media comprising the steps of:

providing a winding machine with:

a wind-from spool used to store the delicate linear media and from which the delicate linear media is removed;

a first motor for rotating the wind-from spool;

a wind-to spool, said wind-to spool being the spool onto which at least a portion of the delicate linear media removed from the wind-from is to be wound;

a second motor for rotating the wind-to spool;

at least one support interconnected to the wind-from spool that allows the wind-from spool to at least one of move laterally and angulate to selectively control the angle of the delicate linear media with respect to the wind-to spool;

a wire tensioning system, said tensioning system comprising a tensiometer and a single tension sensor wheel; and a system controller, said system controller being configured to receive the sensed axial tension and to control the first and second motors;

rotating the wind-from spool using the first motor;

rotating the wind-to spool using the second motor;

sensing the axial tension on the delicate linear media during operation of the winding machine using the wire tensioning system;

sending the sensed axial tension on the delicate linear media to the system controller;

controlling the first and second motors to maintain the sensed axial tension to maintain a desired axial tension on the delicate linear media; and wherein during operation the delicate linear media is not exposed to a bend having a diameter less than 22 inches.

8. The method of claim 7, in which controlling the first and second motors to maintain a desired axial tension on the delicate linear media comprises controlling the rotation speeds of the wind-from and wind-to spools to maintain a desired axial tension on the delicate linear media.

9. The method of claim 8, wherein maintaining a desired axial tension comprises maintaining a desired axial tension within a variance of 0.1 pounds or less.

10. The method of claim 8, wherein the desired axial tension is greater than 0.1 pounds.

11. The method of claim 10, wherein the desired axial tension is less than 5 pounds.

12. The method of claim 10, wherein the desired axial tension is less than 3 pounds.

13. The method of claim 7, wherein the single tension sensor wheel is positioned so that the delicate linear media from the wind-from spool passes around the tension sensor wheel before winding onto the wind-to spool.

14. The method of claim 7, wherein the single tension sensor wheel has a diameter of at least 22 inches.

15. The method of claim 14, wherein the single tension sensor wheel weighs no more than 5 pounds.

16. The method of claim 15, wherein the single tension sensor wheel is supported by a center bolt that is part of a Wheatstone bridge arrangement, and wherein the stress applied to the center bolt by the axial tension in the delicate media is measured by the Wheatstone bridge.

17. The method of claim 16 wherein the axial tension on the media is calculated from at least the diameter of the tension sensor wheel, the temperature, and the measurement of the stress applied to the center bolt.

18. The method of claim 7, wherein the delicate linear media does not pass through any reverse bends.

19. The method of claim 7, wherein the delicate linear media only contacts surfaces moving in the direction of the media motion and having dynamic coefficients of friction.

20. The method of claim 7, wherein the winding machine further comprises a follower wheel located between the tension sensor wheel and the wind-to spool, said follower wheel being positioned so that the delicate linear media from the wind-from passes over the follower wheel before winding onto the wind-to spool, and wherein said method further comprises controlling the lateral position of the delicate linear media as it winds onto the wind-to spool by moving the follower wheel.

21. The method of claim 20, wherein controlling the lateral position of the delicate linear media as it winds onto the wind-to spool maintains the wind-off and wind-on points of the two spools, as well as the tension sensor wheel, in substantially the same plane.

22. The method of claim 21, wherein the winding machine further comprises:

a sensor capable of determining the location of the wire unwinding from the wind-from spool;

a lateral positioning motor for adjusting the lateral position of the wind-from spool; and wherein the method further comprises the step of controlling the lateral position of the wind-from spool so that the wind-off point and the follower wheel are maintained in approximately the same plane.

* * * * *